US011971237B2

(12) United States Patent
Kittley

(10) Patent No.: US 11,971,237 B2
(45) Date of Patent: Apr. 30, 2024

(54) WHEEL ARM FOR A HOWITZER SYSTEM

(71) Applicant: BAE SYSTEMS plc, London (GB)

(72) Inventor: Andrew James Kittley, Barrow-in-Furness (GB)

(73) Assignee: BAE SYSTEMS plc, London (GB)

( * ) Notice: Subject to any disclaimer, the term of this patent is extended or adjusted under 35 U.S.C. 154(b) by 11 days.

(21) Appl. No.: 17/999,458

(22) PCT Filed: May 17, 2021

(86) PCT No.: PCT/GB2021/051177

§ 371 (c)(1),
(2) Date: Nov. 21, 2022

(87) PCT Pub. No.: WO2021/234352

PCT Pub. Date: Nov. 25, 2021

(65) Prior Publication Data

US 2023/0235984 A1 Jul. 27, 2023

(30) Foreign Application Priority Data

May 21, 2020 (GB) ..... 2007581

(51) Int. Cl.
*F41A 23/30* (2006.01)

(52) U.S. Cl.
CPC ..... *F41A 23/30* (2013.01)

(58) Field of Classification Search
CPC ..... F41A 23/28; F41A 23/30; F41A 23/32; F41A 23/34
See application file for complete search history.

(56) References Cited

U.S. PATENT DOCUMENTS 833,636 A * 10/1906 Schneider ..... F41A 23/32 89/40.15
862,502 A * 8/1907 McClean ..... F41A 23/28 89/42.02
962,032 A * 6/1910 Koch ..... F41A 23/28 89/42.02
1,829,669 A * 10/1931 Pavesi ..... F41A 23/36 89/40.11

(Continued)

FOREIGN PATENT DOCUMENTS

GB 14212 8/1913
WO WO 2014057235 A1 4/2014
WO WO 2021234352 A1 11/2021

OTHER PUBLICATIONS

International Search Report and Written Opinion received for PCT/GB2021/051177. Mail date: Aug. 20, 2021. 10 pages.

*Primary Examiner* — Joshua E Freeman
(74) *Attorney, Agent, or Firm* — Finch & Maloney PLLC

(57) ABSTRACT

A wheel arm (114) for a chassis (140) of a towed howitzer system (100). The wheel arm (114) comprises a chassis coupling feature (116) centred on a wheel arm pivoting axis (160), and a wheel coupling feature (118) centred on a wheel rotation axis (162). The chassis coupling feature (116) is spaced apart from the wheel coupling feature (118). The wheel arm (114) comprises a lever engagement feature (122). The lever engagement feature (122), the wheel coupling feature (118) and the chassis coupling feature (116) are provided in series along the length of the wheel arm (114).

17 Claims, 7 Drawing Sheets

(56) References Cited

U.S. PATENT DOCUMENTS

| | | | | | |
|---|---|---|---|---|---|
| 1,956,557 | A * | 5/1934 | Beardsley | F41A 23/28 | 89/40.01 |
| 2,116,526 | A * | 5/1938 | Lucht | F41A 23/28 | 180/41 |
| 2,370,639 | A * | 3/1945 | Dabrasky | F41A 23/28 | 280/124.179 |
| 2,376,849 | A * | 5/1945 | Rossmanith | F41A 23/28 | 89/40.01 |
| 3,315,566 | A * | 4/1967 | Klapdohr | F41A 23/28 | 89/40.01 |
| 2002/0129696 | A1* | 9/2002 | Pek | F41A 23/34 | 89/40.01 |
| 2009/0260513 | A1* | 10/2009 | Eaglestone | F41A 27/24 | 89/41.01 |
| 2010/0024635 | A1* | 2/2010 | Eaglestone | F41A 23/46 | 89/40.02 |
| 2011/0100207 | A1* | 5/2011 | Eaglestone | F41A 23/32 | 89/40.01 |
| 2014/0102286 | A1* | 4/2014 | Dawson | F41A 21/36 | 89/14.3 |

* cited by examiner

WHEEL ARM FOR A HOWITZER SYSTEM

The present disclosure relates to a wheel arm for a towed howitzer system.

In particular the disclosure is concerned with a towed howitzer system comprising a wheel arm of the present disclosure.

BACKGROUND

A howitzer is a type of artillery weapon characterized by a cannon which can fire from low to high angle of elevation and traverse, and the use of propellant charges to propel projectiles. Commonly it is provided on wheels so it may be towed by a vehicle and thus transported to where required. An example of this equipment is illustrated in FIGS. 1 to 3.

In such a towed artillery system the suspension system is "leading arm suspension system". Each wheel 10 is held in front of a suspension pivot point 12 by a wheel arm 14. To tow the platform, pressure is added to suspension struts which force wheel arms 14 to rotate downwards, thereby lifting the chassis of the gun off the ground into a towing configuration (as shown in FIG. 1). The pressure can be added to the suspension strut by way of a manual pump to pump fluid into a suspension strut fluid chamber. The manual pump uses a long bar (known as a pump handle) as a lever arm to manually drive the pump. When the pump is not being used the bar is stored on the howitzer chassis.

To deploy the weapon, fluid is released from the suspension struts which allows the wheel arms to rotate upwards, lowering the platform onto the ground (i.e. moving the arrangement from that shown in FIG. 1 to FIG. 2). To achieve full operability the wheels must be "thrown-over", which involves disconnecting the suspension strut and lifting the wheel up out of the way. By passing the balance point the wheel is retained in the elevated position by gravity. This position is shown in FIG. 3, which is a firing configuration (i.e. the configuration in which the weapon is fully operational). It is also necessary to throw-over the wheels before some maintenance tasks on the brake system to allow access. With the wheels pivoted free of the ground, support legs 16 (if present) may be folded from their storage position (in FIG. 2) to their deployed position (in FIG. 3).

However, a problem with this arrangement is that because the wheel and associated components (e.g. brakes and axels) are heavy, Health and Safety Guidelines require that the operation is a two person lift, the act of which is illustrated in FIGS. 4, 5. The wheel is a large, round, awkward object which is frequently wet/muddy. Therefore throwing-over the wheel can be dangerous for the users and in muddy conditions can be very difficult to achieve, and may result in injury and/or the weapon not being able to be operated to its full capability if the wheel cannot be pivoted to the correct position in time.

Hence a solution which enables the wheels to be moved between the towing configuration and firing configuration, and back again, which reduces risk to the user and increases the chances of a successful deployment regardless of the conditions, is highly desirable.

SUMMARY

According to the present disclosure there is provided a wheel arm, a towed howitzer system, a method of operation of a towed howitzer system and a method of manufacture of a wheel arm as set forth in the appended claims. Other features of the invention will be apparent from the dependent claims, and the description which follows.

Accordingly there may be provided a wheel arm (114) for a chassis (140) of a towed howitzer system (100). The wheel arm (114) may comprise a chassis coupling feature (116) centred on a wheel arm pivoting axis (160), and a wheel coupling feature (118) centred on a wheel rotation axis (162), wherein the chassis coupling feature (116) is spaced apart from the wheel coupling feature (118). The wheel arm (114) may comprise a lever engagement feature (122). The lever engagement feature (122), the wheel coupling feature (118) and the chassis coupling feature (116) may be provided in series along the length of the wheel arm (114).

The lever engagement feature (122) may be provided as a protrusion (130) which extends away from the wheel arm (114) along an engagement feature axis (136).

A line (A-A) may extend between the arm pivoting axis (160) and wheel rotation axis (162) to define a longitudinal axis (128) of the wheel arm (114). The engagement feature axis (136) may be aligned with, parallel to, or at an angle "B" to the longitudinal axis (128).

The protrusion (130) may comprise a wall (132) which defines a cavity (134), with an opening (138) centred on the engagement feature axis (136). A drain aperture (142) may extend through the wall (132).

A plurality of drain apertures (142) may extend through the wall (132).

The lever engagement feature (122) may be provided as a cavity (234) which extends into the wheel arm (114). The cavity (234) may extend along an engagement feature axis (136).

There may also be provided a towed howitzer system (100) comprising a wheel arm (114) according to the present disclosure, a chassis (112), wherein the wheel arm (114) is pivotably coupled to the chassis (112) via the chassis coupling feature (116); and a lever (300) provided with a coupling feature (302) at a coupling end (310) configured to engage with the lever engagement feature (122). The lever (300) may comprise a handle region (312) at a free end (314) opposite to the coupling end (310).

The coupling feature (302) of the lever (300) and the lever engagement feature (122) may be configured so that the coupling feature (302) of the lever (300) is a passage (306) defined by a wall of the lever (300), the passage (306) configured to receive the lever engagement feature (122) of the wheel arm (114).

The lever engagement feature (122) may be the cavity (134, 234), and the coupling feature (302) of the lever (300) may be configured to extend into the cavity (134, 234).

There may also be provided a method of operation of a towed howitzer system (100), the howitzer system comprising: a wheel arm (114) pivotably coupled to a chassis (112) of the howitzer; the wheel arm (114) comprising a chassis coupling feature (116) centred on an arm pivoting axis (160) and a wheel coupling feature (118) centred on a wheel rotation axis (162). The chassis coupling feature (116) may be spaced apart from the wheel coupling feature (118). A lever (300) may extend from the wheel arm (114) to a handle region (312) at a free end (314). The lever (300), the wheel coupling feature (118) and chassis coupling feature (116) may be provided in series along the length of the wheel arm (114). The method may comprise the steps of: a user (400) grasping the handle region (314) of the lever (300) and applying a force to the lever (300) so that the wheel arm (114) pivots relative to the chassis (112) about the arm pivoting axis (160).

The method of operation may further comprise the step of coupling the lever (300) to the wheel arm (114).

The method of operation may further comprise the step of the step of coupling the lever (300) to the wheel arm (114) so that the handle region (314) of the lever (300) is positioned just below shoulder height of the user when the user is kneeling.

The howitzer system may further comprise a suspension system. The method may further comprise the step of operating the suspension system with the lever (300) when the lever (300) is disconnected from the wheel arm (114).

There may also be provided a method of manufacture of a wheel arm (114) according to the present disclosure, comprising the steps of: providing a wheel arm precursor; attaching a lever engagement feature (122) to the wheel arm (114).

The method of manufacture may further comprise the step of: preparing the region of the wheel arm precursor to which the lever engagement feature (122) is to be attached before attaching the lever engagement feature (122) to the wheel arm precursor.

Hence there is provided a wheel arm, a towed howitzer system, a method of operation of a towed howitzer system and a method of manufacture of a wheel arm. These reduce risk to the user, and increases the chances of a successful weapon deployment regardless of the conditions. The provision of a lever engagement feature on the wheel arm enables a lever to be attached to the wheel arm so the wheels of the towed howitzer may be moved between a towing configuration and a firing configuration, and back again, in an operation that is less strenuous than possible with arrangements of the related art, such that the operation may comply with Health and Safety Guidelines.

BRIEF DESCRIPTION OF THE DRAWINGS

Examples of the present disclosure will now be described with reference to the accompanying drawings, in which.

DETAILED DESCRIPTION

Figure 1:
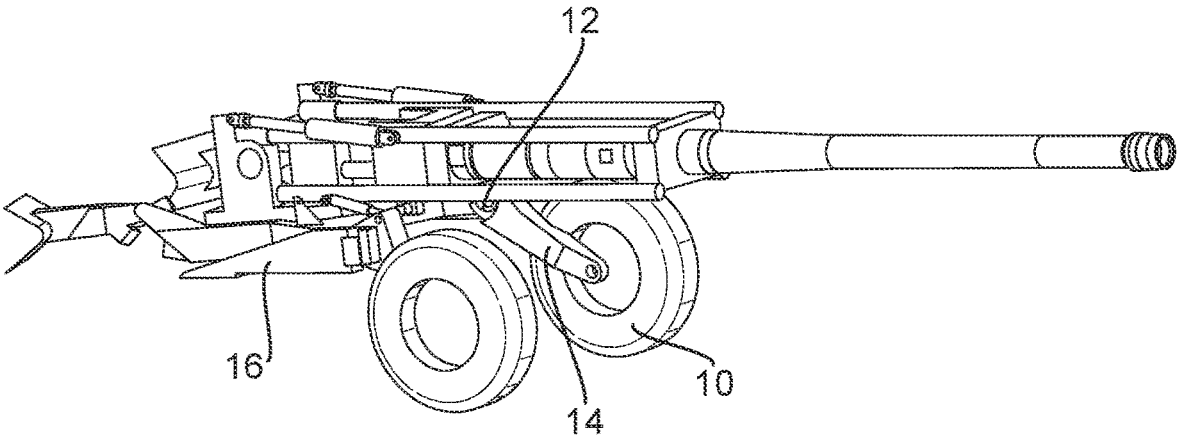
FIGS. 1 to 5 show a conventional towed artillery system and method of use.
Figure 2:
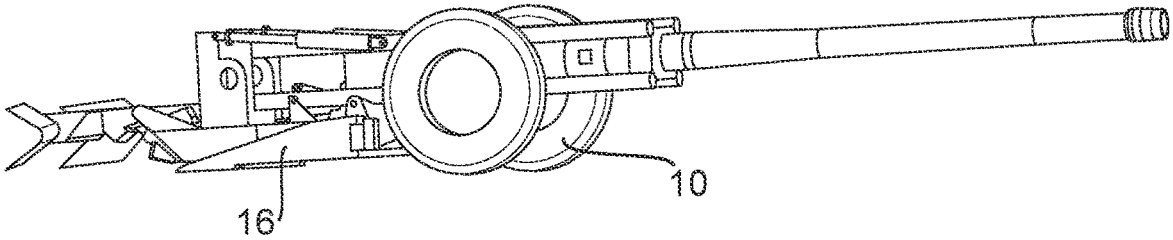
Figure 3:
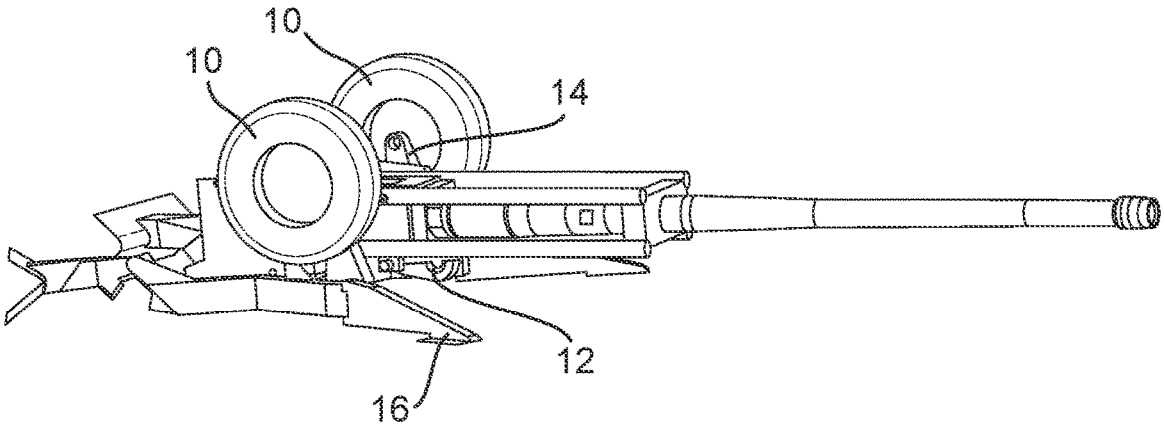
Figure 4:
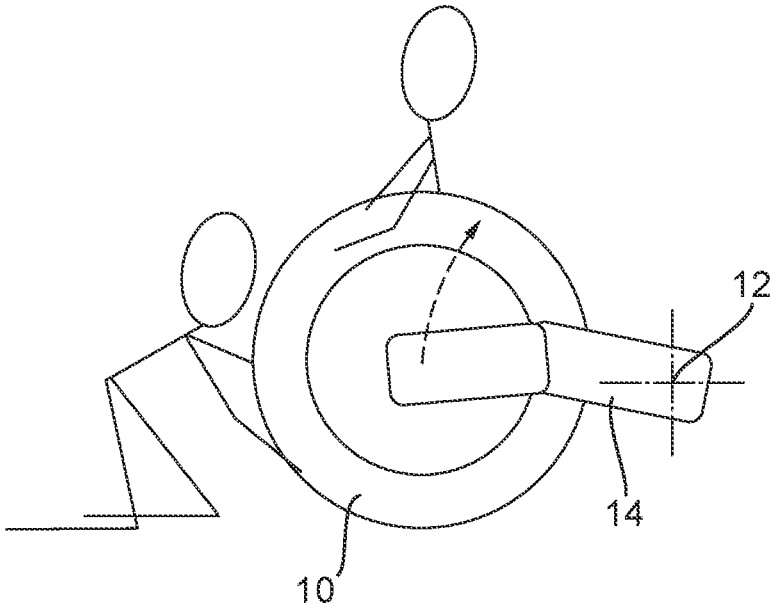
Figure 5:
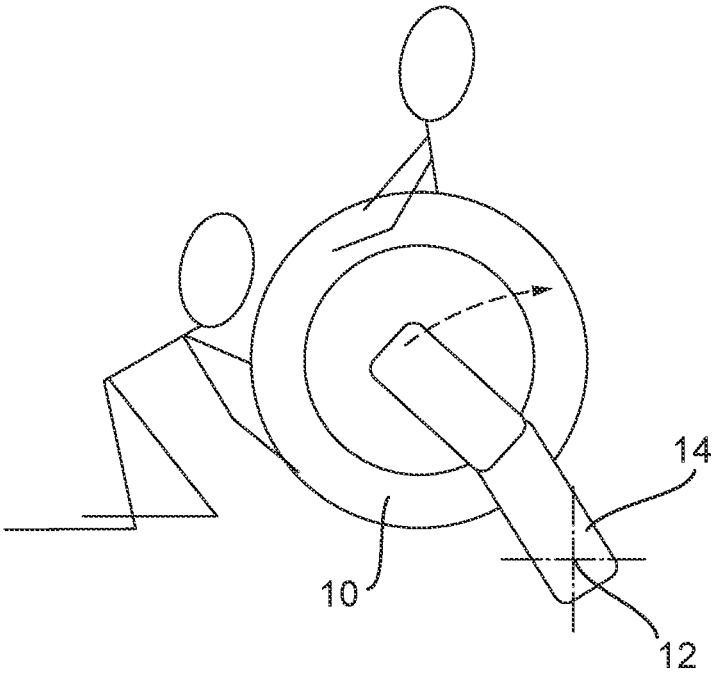

The present disclosure relates to a wheel arm, a towed howitzer system including a wheel arm of the present disclosure, a method of operation of a towed howitzer system including a wheel arm of the present disclosure and a method of manufacture of a wheel arm of the present disclosure.

The howitzer system 100 of the present disclosure comprises a weapon unit 102 carried on a chassis 112. A wheel arm 114 extends from either side of the chassis 112. Each wheel arm 114 extends from the chassis 112 to support a wheel 110 which supports the chassis 112 when it is being transported (i.e. towed). A suspension system (not shown, but may be of a conventional kind) is provided to further support the wheel arms 114.

Figure 6:
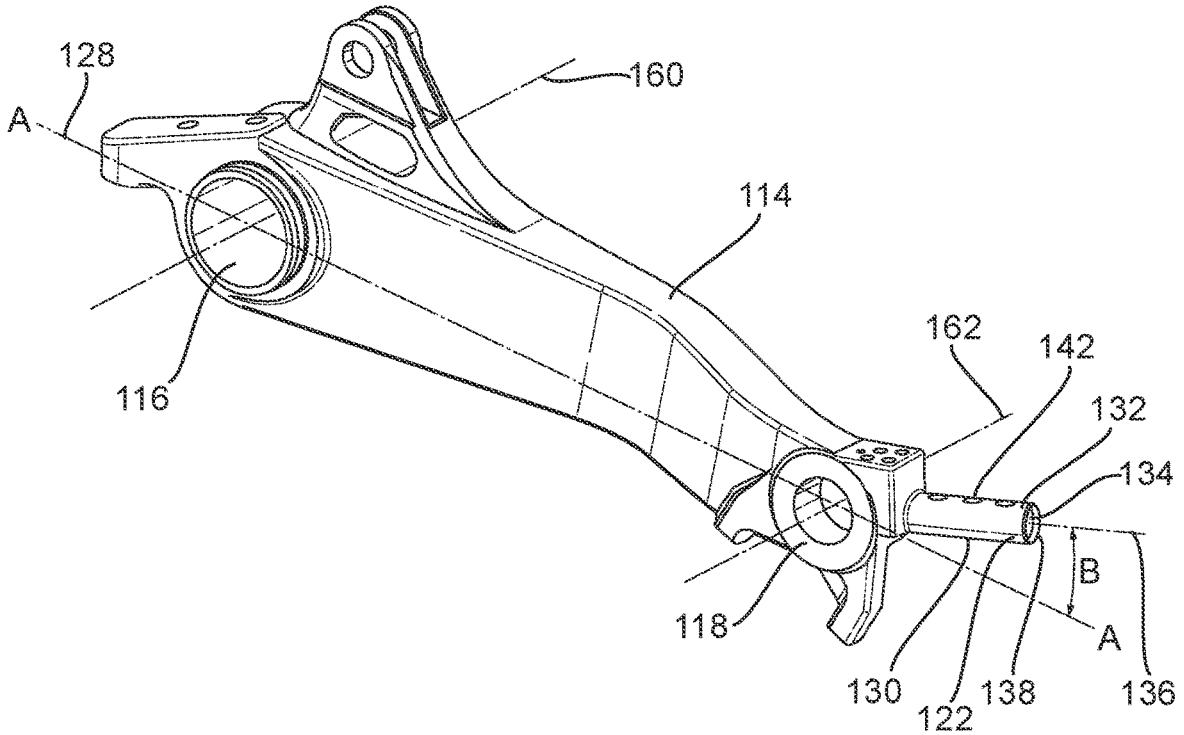
FIGS. 6, 7 show an example wheel arm according to the present disclosure.
Figure 7:
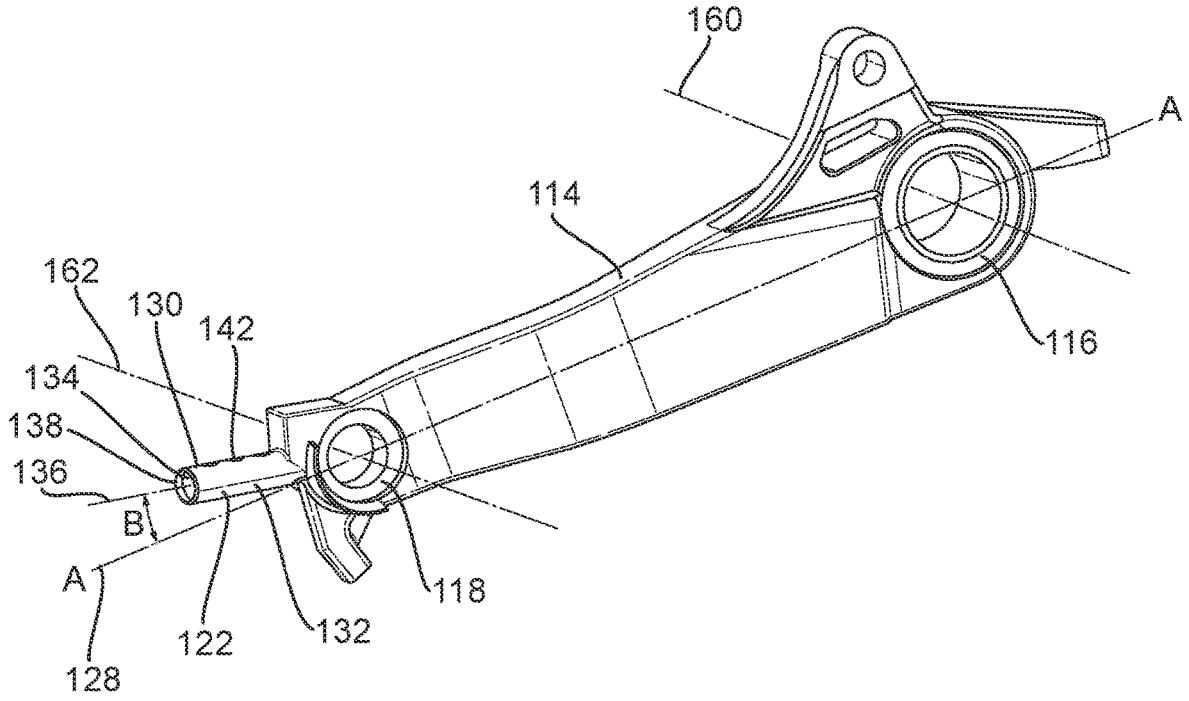
Figure 8:
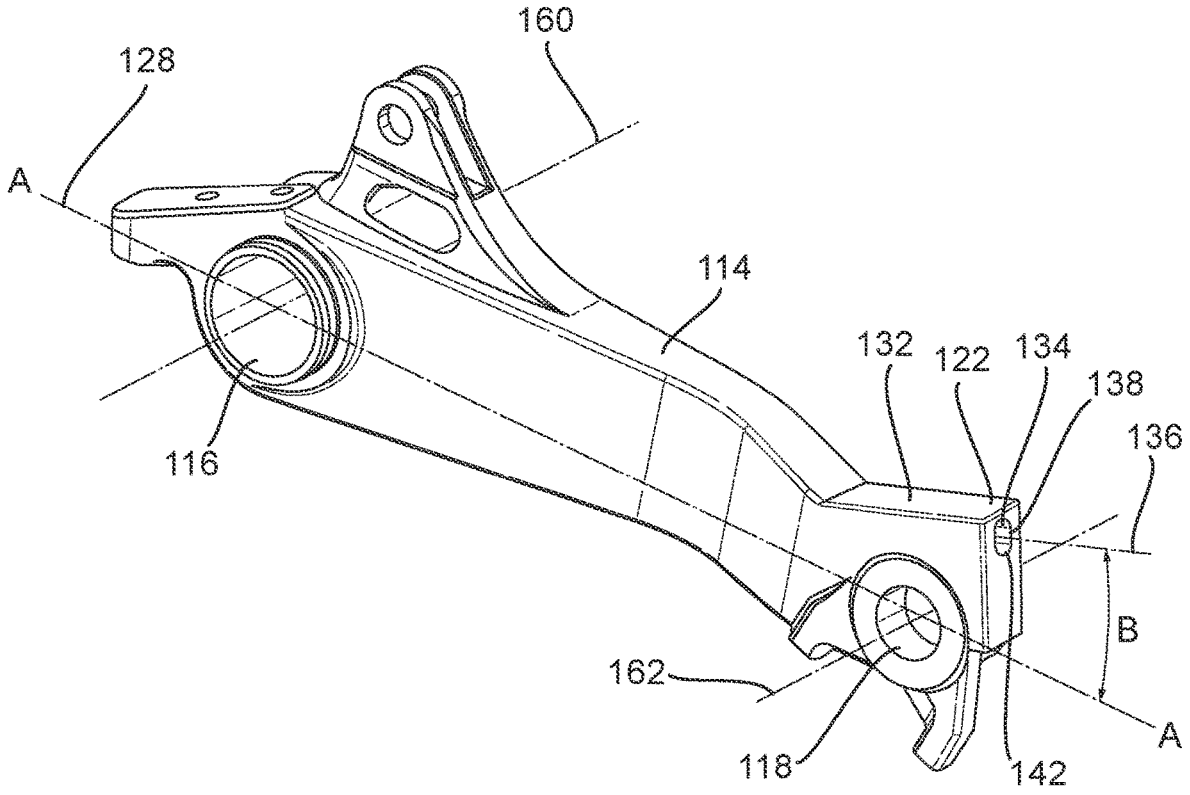
FIG. 8 shows an alternative example of a wheel arm according to the present disclosure.
Figure 9:
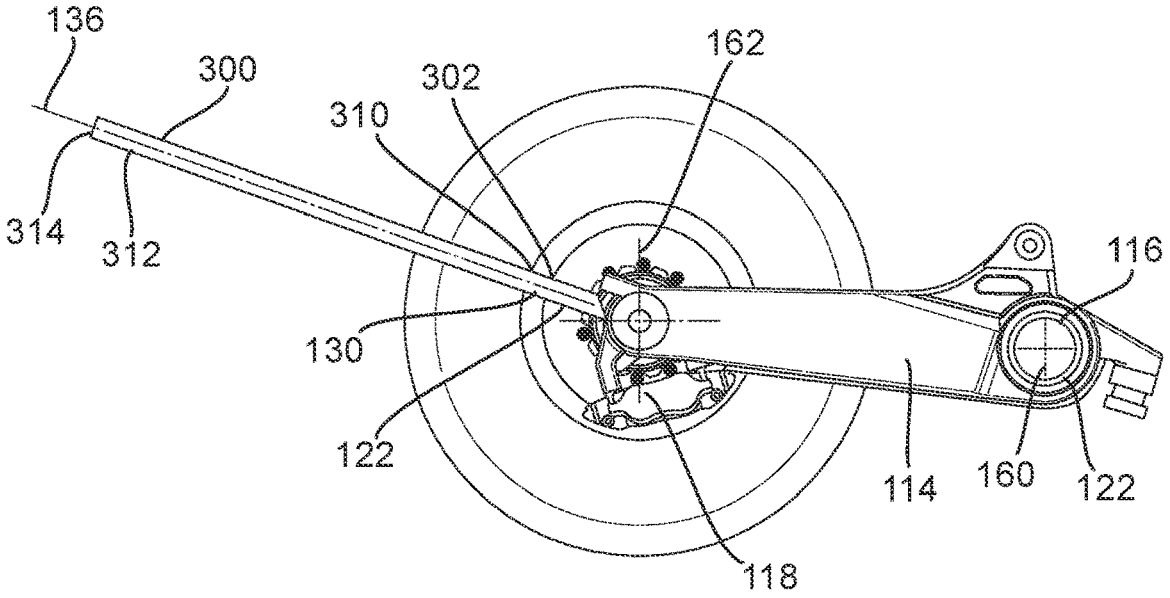
FIG. 9 shows part of a howitzer system according to the present disclosure.

A first example of a wheel arm 114 according to the present disclosure is shown in FIGS. 6, 7. A second example of a wheel arm according to the present disclosure is shown in FIG. 8. FIG. 9 shows a side view of a wheel arm 114 on which a wheel 110 of the howitzer system is rotatably mounted.

The wheel arm 114 is pivotably coupled/mounted to the chassis 112. As shown in FIGS. 6, 7, the wheel arm 114 may comprise a chassis coupling feature 116 (for example a bearing unit or part thereof) which centred on an arm pivoting axis 160, and is configured to allow the wheel arm 114 to pivot relative to the chassis 112 about the arm pivoting axis 160. The wheel arm 114 may also comprise a wheel coupling feature 118 (for example a bearing unit or part thereof) centred on a wheel rotation axis 162, for rotatably mounting a wheel 110 to the wheel arm 114, and configured to allow the wheel 110 to rotate relative to the wheel arm 114 around the wheel rotation axis 162.

The wheel arm 114 is configured to be coupled to a suspension system, either directly or indirectly, so that the wheel coupling feature 118 is spaced apart from the chassis 112 by the suspension system. The suspension system may be of a conventional kind, and configured to damp vibrations and shock loads when the howitzer is being transported on its wheels 110.

The chassis coupling feature 116 is spaced apart from the wheel coupling feature 118. Hence the arm pivoting axis 160 is spaced apart from the wheel rotation axis 162.

A line (shown as line "A-A" in FIGS. 6, 7, 8) which extends between the arm pivoting axis 160 and wheel rotation axis 162 defines a longitudinal axis 128 of the wheel arm 114. Hence the nominal length of the wheel arm 114 extends along the line A-A. That is to say, the line A-A defines the longitudinal axis 128 (e.g. directional "length") of the wheel arm 114. This is the case even where, as shown in the example of FIG. 10, the wheel arm 114 may have a "dog leg" shape (i.e. not straight).

Figure 10:
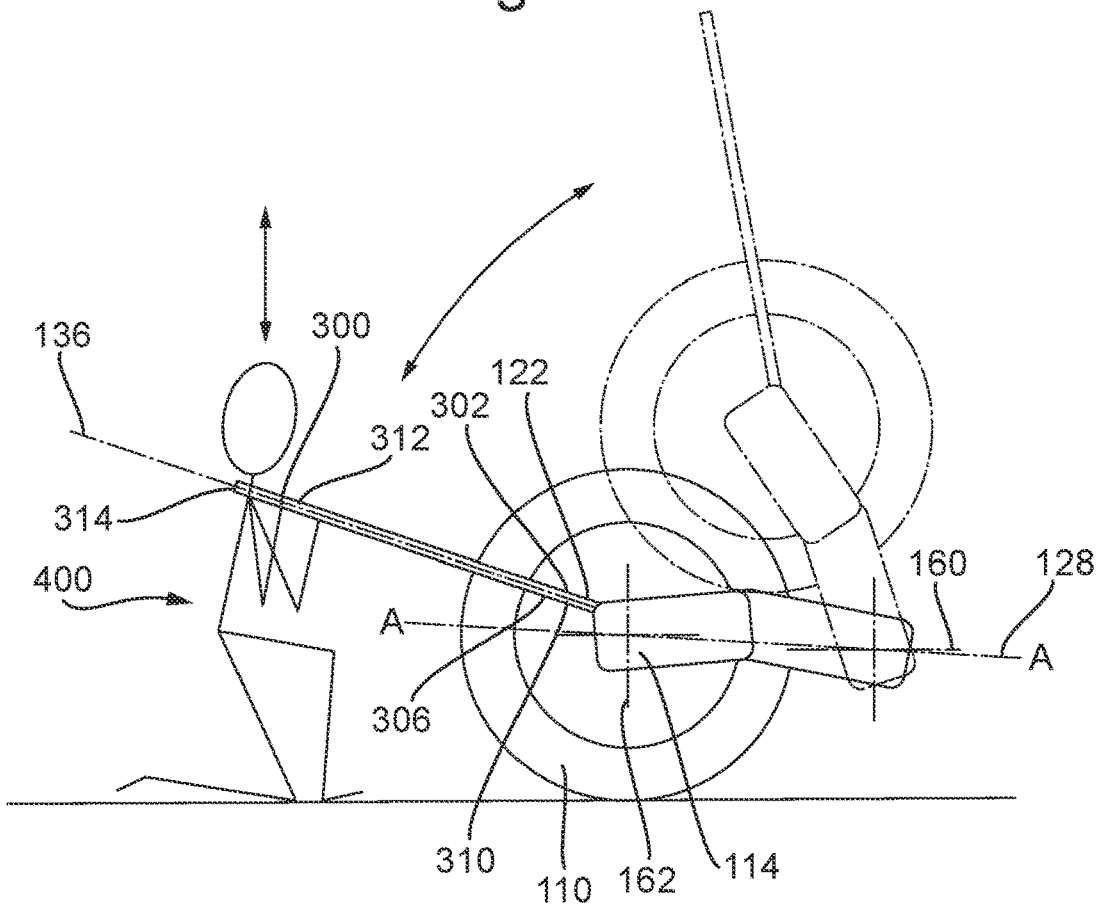
FIG. 10 shows how the system of FIG. 9 may be operated.

As shown in FIGS. 9, 10 there may also be provided a lever 300 which is operable to extend from the wheel arm 114 to a handle region 312 at a free end 314 of the lever 300. The lever 300, the wheel coupling feature 118 and chassis coupling feature 116 may be provided in series along the length (i.e. longitudinal axis 128) of the wheel arm 114. Hence the lever 300, the wheel rotation axis 162 and the arm pivoting axis 160 and may be arranged in series along the length (i.e. longitudinal axis 128) of the wheel arm 114. The lever 300 may be provided separately to the wheel arm 114.

The wheel arm 114 may comprise a lever engagement feature 122, as shown in FIGS. 6, 7, 8, to couple/engage the lever 300 and the wheel arm 114.

The lever 300 may comprise a coupling feature 302 at a coupling end 310 configured to engage with the lever engagement feature 122, with the handle region 312 and free end 314 being opposite to the coupling end 310.

The wheel coupling feature 118 is located between the lever engagement feature 122 (and/or lever 300) and the chassis coupling feature 116. The wheel rotation axis 162 may be located between the lever engagement feature 122 (and/or lever 300) and the wheel arm pivoting axis 160 along the length (i.e. longitudinal axis 128) of the wheel arm 114.

Figure 11:
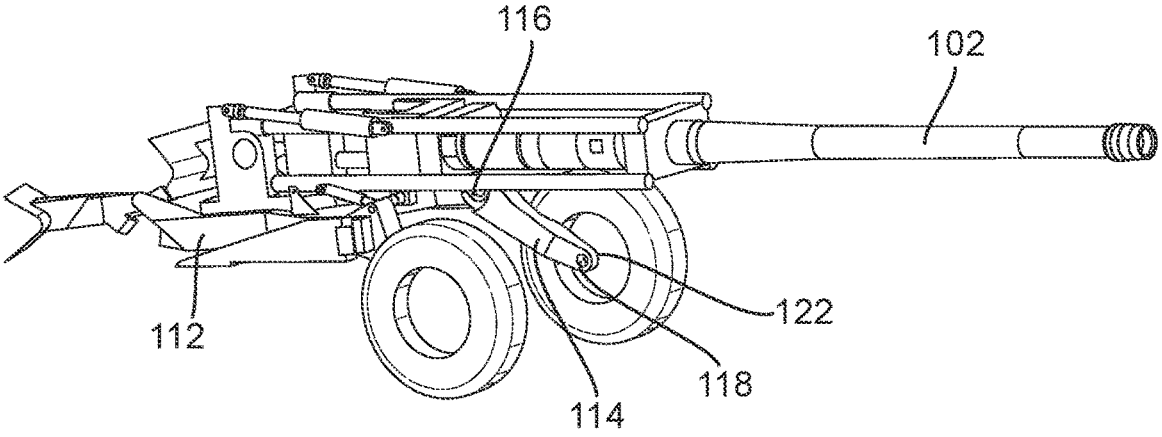
FIGS. 11, 12, 13 show the howitzer system according to the present disclosure in a first mode of operation, switching it from the towed configuration to a firing configuration.
Figure 12:
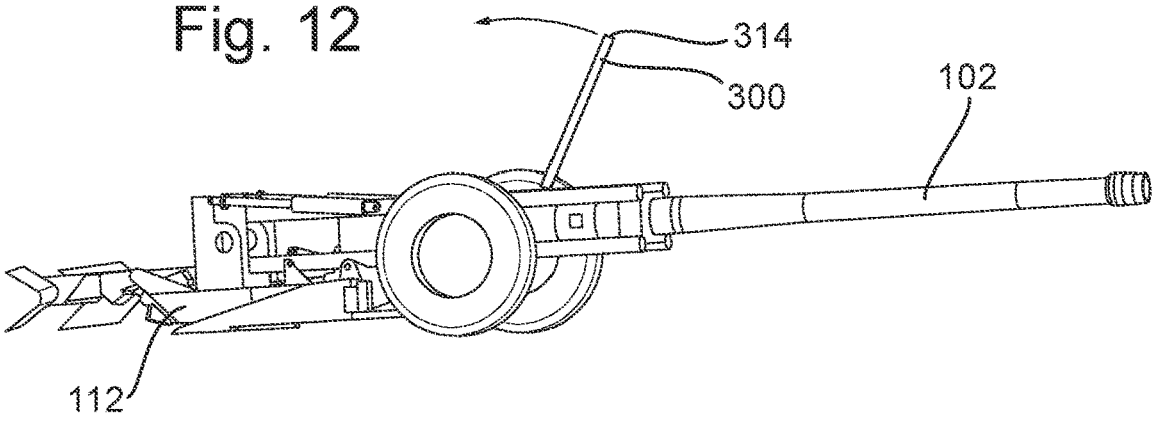
Figure 13:
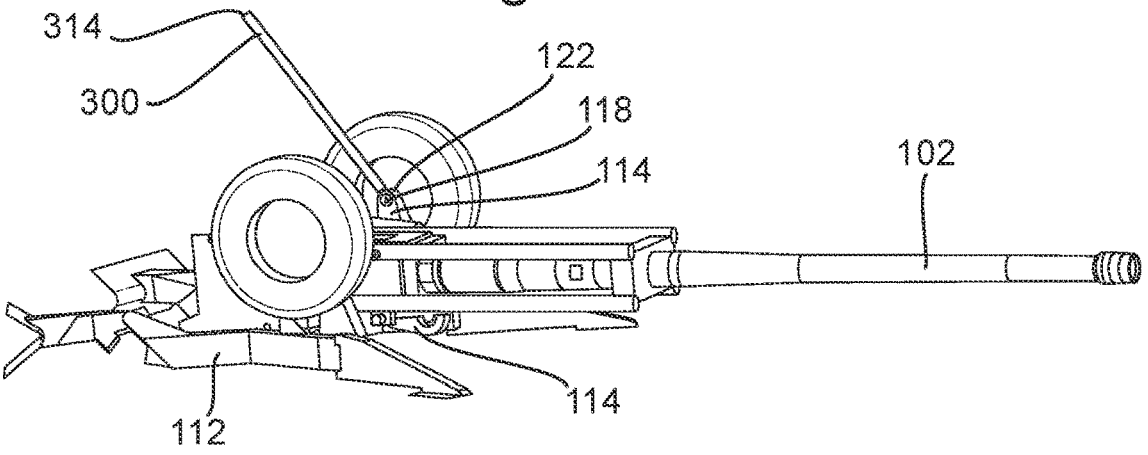

FIG. 10 shows how the wheel arm 114 may be pivoted from one configuration to another about the arm pivoting axis 160. FIGS. 11 to 13 show how the wheel arms 114 of a howitzer system according to the present disclosure may be pivoted from a towing configuration (FIG. 11) to an initial deployed configuration (FIG. 12) and then to a firing configuration (FIG. 13). The wheel arm 114 may be disconnected from the suspension system (e.g. from supporting struts of the suspension system) between the initial deployed configuration (FIG. 12) and firing configuration (FIG. 13), although remains coupled to the chassis 112 by the chassis coupling feature 116.

Figure 14:
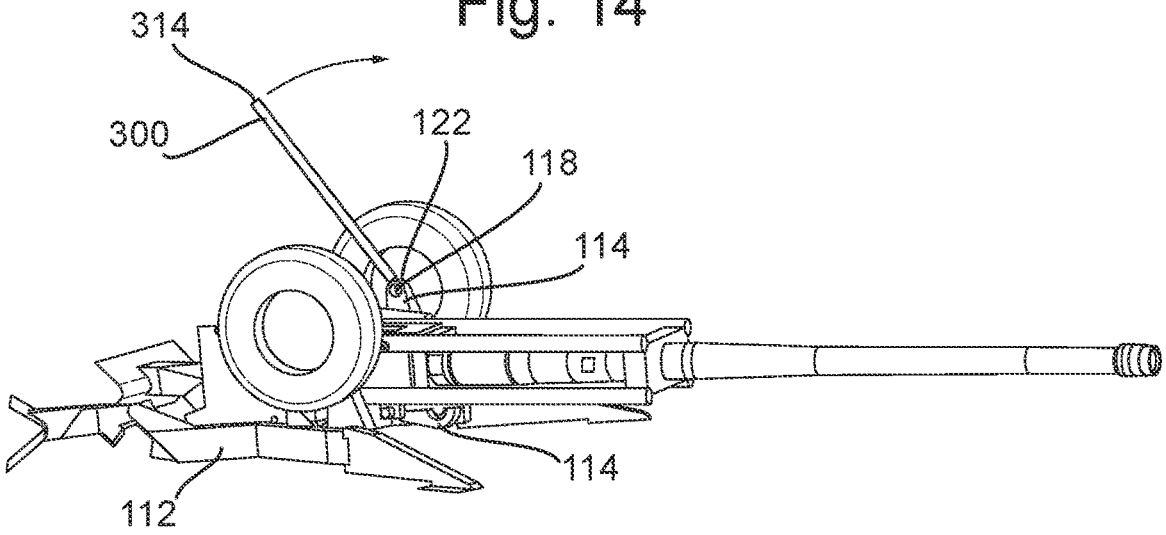
FIGS. 14, 15, 16 show the howitzer system according to the present disclosure in a second mode of operation, switching it from the firing configuration to the towed configuration.
Figure 15:
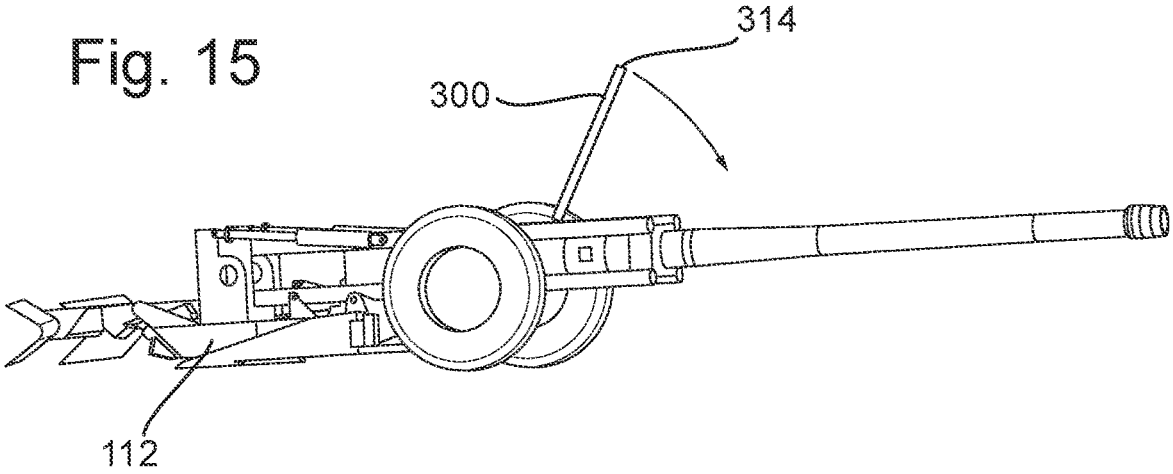
Figure 16:
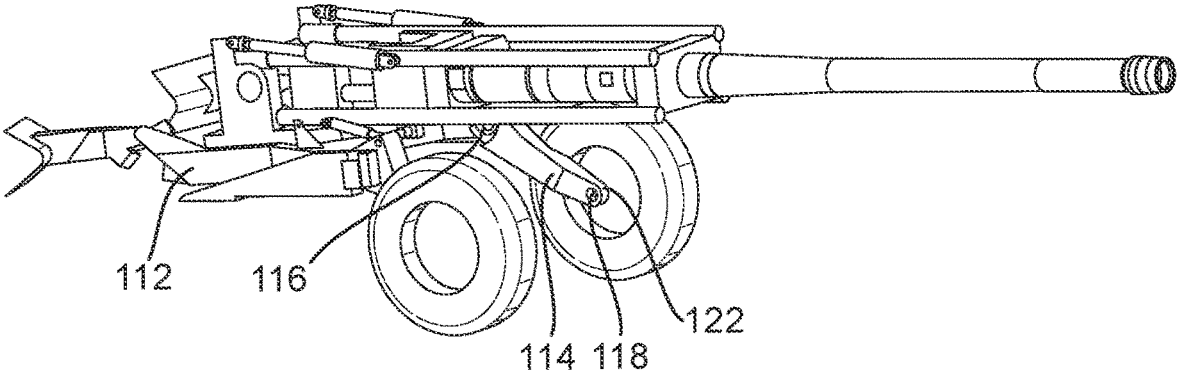

FIGS. 14 to 16 show how the wheel arms 114 of a howitzer system according to the present disclosure may be pivoted from a firing configuration (FIG. 14) to an initial "wheels on ground" configuration (FIG. 15) and then a towing configuration (FIG. 16). The wheel arm 114 may be connected to the suspension system between the initial deployed configuration (FIG. 12) and firing configuration (FIG. 13).

In the example shown in FIG. 6, 7, the lever engagement feature 122 may be provided as a protrusion 130 which extends away from the wheel arm 114 along an engagement feature axis 136. The protrusion 130 may be in the form of a spigot or other extension. The protrusion 130 may be provided at or towards the end of the wheel arm 114 distal to the arm pivoting axis 160/chassis coupling feature 116. The protrusion 130 may extend from the nominal top, bottom and/or sides of the wheel arm 114.

The protrusion 130 comprises a wall 132 which defines a cavity 134. Hence the protrusion 130 may be hollow, for example a hollow tube, as shown in FIGS. 6, 7. The wall 132 defines an opening 138 centred on the engagement feature axis 136. The cavity 134 is centred on, and extends along, the engagement feature axis 136. A drain aperture 142 extends through the wall 132 at an angle (e.g. at right angles) to the engagement feature axis 136. As shown in the examples of FIG. 6, 7, there may be provided a plurality of drain apertures 142 which each extend through the wall 132 at an angle to the engagement feature axis 136. The apertures 142 may be provided around the circumference of the wall 132 and/or in lines along the length of the wall 132 (for example along the nominal top and bottom surfaces of the wall 132). The drain apertures 142 are provided so that any water, dirt and foreign objects may be expelled from the cavity 134.

In the alternative example of FIG. 8, the lever engagement feature 122 is provided as a cavity 234 which extends into the wheel arm 114. The cavity 234 has at least one opening 138 to the outside of the wheel arm 144. As in the preceding examples, drain apertures as described in relation to the examples of FIGS. 6, 7 may also be provided in this example. The opening 138 is centred on the engagement feature axis 136. The cavity 234 is centred on, and extends along, the engagement feature axis 136.

In both examples, the lever engagement feature 122 may be formed integrally with the wheel arm 114, welded to the wheel arm, and/or attached by some mechanical means, for example a bracket or adapter using a fixing means such as a bolt, screw and/or rivet.

In the examples shown the engagement feature axis 136 is provided at an angle "B" to the longitudinal axis 128 (line A-A). The angle B may be at least 10 degrees but not more than 80 degrees. The angle B may be at least 10 degrees but not more than 60 degrees. The angle B may be at least 10 degrees but not more than 50 degrees. The angle B may be at least 10 degrees but not more than 30 degrees.

In an alternative example the engagement feature axis 136 is aligned with the longitudinal axis 128 (line A-A). In further alternative example the engagement feature axis 136 is parallel to the longitudinal axis 128 (line A-A).

The lever engagement feature 122, the wheel coupling feature 118 and chassis coupling feature 116 are provided in series along the length of the wheel arm 114. Hence the arm pivoting axis 160, wheel rotation axis 162 and lever engagement feature 122 are provided in series along the length of the wheel arm 114.

In the examples shown, the coupling feature 302 of the lever 300 is configured to extend into the cavity 134, 234 of the lever engagement feature 122. Hence in this example the external diameter of the coupling feature 302 of the lever 300 is slightly smaller than the internal diameter of the cavity 134, 234. The lever 300 is thus located and engaged with the wheel arm 114 via the lever engagement feature 122. Any foreign matter in the cavity 134, 234 may be expelled through the drain apertures 142 by the insertion of the lever 300 into the cavity 134, 234.

In an alternative example, the coupling feature 302 of the lever 300 and the lever engagement feature 122 are configured so that the coupling feature 302 of the lever 300 is a passage 306 defined by a wall of the lever 300. In such an example the lever engagement feature 122 (e.g. the protruding spigot) is configured to be received by the passage 306 of the lever 300. Hence in this example the internal diameter of the passage 306 of the lever coupling feature 302 is greater than the external diameter of the protrusion 130.

Hence the lever 300 is attached to the lever engagement feature 122 spigot/protrusion at the end, or towards one end, of the wheel arm 114. The lever 300 and lever engagement feature 122 may be engaged/disengaged by sliding one relative to the other.

The distance from the coupling end 310 of the lever 300 to the handle region 312 may be the same or greater than the distance from the arm pivoting axis 160 to where the lever engagement feature 122 extends from the wheel arm 114. The distance from the coupling end 310 of the lever 300 to the handle region 312 may be twice, but no more than three times, the distance from the arm pivoting axis 160 to where the lever engagement feature 122 extends from the wheel arm 114.

The length of the lever 300, and the angle B, are configured, determined and/or set such that with the lever 300 coupled to the wheel arm 114, and/or the lever 300 extending from the wheel arm 114, with the wheel 110 supported on the ground, a user kneeling on the same ground, at the same level, may have the handle region 314 of the lever 300 positioned at about shoulder height.

The lever 300 may also be configured for other operations. For example the lever 300 may be operable to engage with the chassis suspension, and used to pump up (e.g. pressurise) the suspension (i.e. to change the configuration from an initial "wheels on ground" configuration (FIG. 15) to the towing configuration (FIG. 16). Hence the lever 300 may be configured to be disconnected from the wheel arm 114 once the wheels are in the "wheels on ground" configuration (FIG. 15) so that the lever may be used to pressurise the suspension.

When not in use, the lever 300 may be stored on or in the chassis 112.

The method of operation of the apparatus may comprise the steps of the user 400 grasping the handle region 314 of the lever 300 extending from the wheel arm 114, and applying a force to the lever 300 so that the wheel arm 114 pivots relative to the chassis 112 about the wheel arm pivoting axis 160. Hence by using the lever 300 the wheel arm 114 may be pivoted so that the wheels 110 are pivoted from an initial "wheels on ground" or "initial deployed configuration" (i.e. when the chassis 112 has been lowered to the ground, as shown in FIG. 12) to a configuration in which the weapon can be fired (the "firing configuration", as shown in FIGS. 13, 14). The wheel arms 114 may be pivoted using the lever 300 so that the wheels 110 are pivoted from the "firing position" as shown in FIG. 14 to a configuration in which the howitzer may be prepared for being towed (an "initial deployed configuration", as shown in FIG. 15). For example, when the gun needs to be moved, the wheel arms 114 are pivoted using the lever 300 so the wheels are in a ground supporting position (the "initial deployed position" in FIG. 15) and the suspension system of the howitzer is then connected and/or pumped up to bring the howitzer to a "towing configuration", as shown in FIG. 16, in which the chassis 112 has been lifted clear of the ground.

The method of operation may further comprise the step of coupling the lever 300 to the wheel arm 114. This may be done in the "initial deployed configuration" (FIG. 12) or the firing configuration (FIG. 14). The method of operation may further comprise the step of de-coupling the lever 300 from the wheel arm 114. This may be done in the firing configuration (FIG. 13) or in the "wheels on ground" configuration (FIG. 15). The method of operation may further comprise the step of coupling the lever 300 to the suspension system, and then using the lever 300 to configure the suspension system (for example to pump/pressurise the suspension system in preparation for towing of the howitzer, FIG. 16).

Hence the method may comprise the step of operating the suspension system with the lever 300 when the lever 300 is disconnected from the wheel arm 114.

The method of operation may further comprise the step of deploying the lever 300.

The method may also comprise the steps of attaching the lever 300 to the lever engagement feature 122 on the wheel arm such that, when the wheels arms 114 and wheels 110 are in the "wheels on ground" or "initial deployed configuration" (i.e. when the chassis 112 is in contact with the ground, as shown in FIGS. 12, 15) the end 314 of the lever 300 is approximately the height of a user's shoulder when the user is kneeling down (for example on one knee). That is to say the method of operation may comprise the step of coupling the lever 300 to the wheel arm 114 when the wheels are supported on the ground so that the handle region 314 of the lever 300 is positioned just below shoulder height of a user when the user is kneeling on the same level (i.e. on the same ground) as the wheel 100. Hence for example, with reference to FIGS. 9, 10, the method of operation may comprise the step of coupling the lever 300 to the wheel arm 114, and/or extending the lever 300 from the wheel arm 114, when the wheels are supported on the ground so a user kneeling on the same ground, at the same level, may have the handle region 314 of the lever 300 positioned at about shoulder height.

In this configuration a user may deploy most of the force required using his/her leg muscles, moving from a kneeling position to a standing position, with one arm close to his/her body, and his/her other arm used to steady the lever to thus move the wheel arms 114 from the "initial deployed configuration" (as shown in FIG. 12) to the "firing configuration" (as shown in FIG. 13). Also a user may deploy most of the force required using his/her leg muscles, with one arm close to his/her body, and his/her other arm used to steady the lever to thus move the wheel arms 114 from the "firing configuration" (as shown in FIGS. 13, 14) to the "wheels on ground" configuration shown in FIG. 15.

The process by which the design of the apparatus and method of the present disclosure are determined and set is based on criteria 1 to 4 below. In particular the angle B at which the lever 300 extends from the wheel arm 114, and length of the lever 300, is a function of the criteria 1 to 4 below. The method of operation according to the present disclosure may also include one of more of the following features of criteria 1 to 4 below.

1) Compliance with MIL-STD-1472 (Human Design for Engineering Criteria Standards);
2) Providing hand interfaces which enable:
   a. Strongest grip;
   b. An arm position which gives the strongest upper body strength;
   c. Safe grip which has a low probability of damaging the hand;
   d. Two handed grip for best stability; and/or
   e. Produces the least twist to the body.
3) Lifting requirements, enabling user to:
   a. Use their thigh muscles to do the work;
   b. Remove bending of the spine and keep the back as straight as possible to avoid overload;
   c. Avoid twisting of their back/spine;
   d. Not use their arms or shoulders for the most strenuous part of the lift;
   e. Position the handle of the lever as close to the user's shoulder as possible as this is the strongest interface on the upper body.
4) If the lift fails, the riskiest part of the lift is at the beginning—thus the user should be as far away from the wheel as possible, and the user's hands and feet should be clear of the area where hardware may drop to the ground.

There may also be provided a method of retro fitting a wheel arm of the present disclosure to an existing howitzer system. The method may include the steps of: removing a wheel arm from a howitzer system and fitting a wheel arm according to the present disclosure to the howitzer system (i.e. replacing a wheel arm of a howitzer system with a wheel arm according to the present disclosure).

There may also be provided a method of manufacture of a wheel arm 114 according to the present disclosure, the method comprising the steps of: providing a wheel arm precursor and attaching a lever engagement feature 122 as hereinbefore described to the wheel arm precursor. In this context, the word "wheel arm precursor" is intended to mean an article that forms the basis for, but does not have all of the features of, the wheel arm of the present disclosure.

There may also be provided a method of manufacture of a wheel arm 114 according to the present disclosure, the method comprising the steps of integrally forming a wheel arm 114 and lever engagement feature 122 as hereinbefore described, for example in a casting or 3D printing process.

There may also be provided a method of retro fitting a lever engagement feature 122 to a wheel arm of a howitzer system. This may comprise the steps of attaching/fixing a lever engagement feature 122 of the present disclosure to a wheel arm, for example by welding, bonding, bolting or clamping, or some other appropriate method.

There may also be provided a method of replacing a lever engagement feature 122 of a wheel arm according to the present disclosure. This may comprise the step of preparing the region of the wheel arm 114 to which the lever engagement feature 122 of the present disclosure is to be attached before attaching the lever engagement feature 122 to the wheel arm 114. For example, a damaged and/or worn lever engagement feature 122 may need to be removed and the surface to which the replacement lever engagement feature 122 is to be fixed may need to be configured so that the replacement lever engagement feature 122 can be fitted in place.

There may also be provided a kit of parts comprising wheel arm according to the present disclosure and a lever for use with the wheel arm. Additionally or alternatively the kit of parts may comprise a wheel arm precursor and a lever engagement feature configured to be fitted to the wheel arm precursor. The kit of parts may comprise a howitzer chassis 112, a lever 300 and a wheel arm 114 comprising a lever engagement feature 122.

In an alternative example the lever 300 may be configured to be retained in the wheel arm 114, and slid out of the wheel arm 114 when required.

There is thus provided a wheel arm 114 fora towed howitzer (i.e. a wheel arm 114 for fitting to a chassis 140 of a towed howitzer system), a towed howitzer system including a wheel arm of the present disclosure, a method of operation of a towed howitzer system including a wheel arm of the present disclosure and a method of manufacture of a wheel arm of the present disclosure.

Providing a lever engagement feature 122 so that they lever may be fixed to the wheel arm 114 means that a lever may be used to move the wheel arm 114, and the attached wheel, into a desired position. Additionally or alternatively, configuring the wheel arm to include a lever (that is to say, providing the wheel arm with a lever) provides a technical advantage over examples of the prior art.

The use of a lever provides mechanical advantage for "throwing the wheel over". The lever provides a location for the user to apply a force to the wheel arm which is further from the wheel arm pivoting axis 160 than the wheel. That is to say, the lever increases (for example doubles) the available distance to the wheel arm pivoting axis 160 for a user to act on, and thereby reduces (for example halves) the required force to pivot the wheel arm. Hence compared to examples of the related art, in which the procedure may require two users to pivot the wheel arm, and put them both risk of injury, the apparatus of the present disclosure results in the same effect being achieved by a single user who can complete the wheel pivot with a reduced risk of injury. The apparatus of the present disclosure also provides the user with a comfortable gripping point (i.e. handle and/or handle region) to move the wheel.

Consequently not only are fewer people required to move the wheels of the howitzer to the desired position, with lower risk of injury, but also other members of the crew are free to conduct other necessary operations, thereby reducing the time to deploy the howitzer, or to configure the howitzer ready to be towed. Hence the provision of a lever for moving the wheel arm has a considerable effect on operational success of the howitzer system.

In examples of the related art, the wheels of the howitzer must be braked to allow users to pivot their wheels. If the wheels are free to rotate about their respective wheel rotation axes it is harder to hold the wheel while it is being pivoted about the wheel arm pivoting axis. If the brake has failed, or a user omits to apply the brake, then the rotation of the wheel can cause serious injury, for example because rotation of the wheel can cause a user to lose their grip and/or balance and suffer injury, for example if they fall or twist a body part. However, the equipment of the present disclosure does not require the brakes to be applied because the user does not need to hold the wheel in order to pivot the wheel arm to the desired position, and hence a further problem of the related art is avoided.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A wheel arm for a chassis of a towed howitzer system, the wheel arm comprising:

a chassis coupling feature centered on a wheel arm pivoting axis;

a wheel coupling feature centered on a wheel rotation axis, wherein the chassis coupling feature is spaced apart from the wheel coupling feature; and a lever engagement feature provided as a protrusion which extends away from the wheel arm along an engagement feature axis, the protrusion comprising a wall defining a cavity with an opening centered on the engagement feature axis, and the wall defines a drain aperture extending through the wall;

wherein the lever engagement feature, the wheel coupling feature, and the chassis coupling feature are provided in series along the length of the wheel arm.

2. The wheel arm of claim 1, wherein:

a line extending between the wheel arm pivoting axis and wheel rotation axis defines a longitudinal axis of the wheel arm; and the engagement feature axis is aligned with, parallel to, or at an acute angle to the longitudinal axis.

3. The wheel arm of claim 1, wherein the drain aperture is one of a plurality of drain apertures that extend through the wall.

4. The wheel arm of claim 1, wherein:

the lever engagement feature is provided as a cavity which extends into the wheel arm; and the cavity extends along an engagement feature axis.

5. A towed howitzer system comprising:

the wheel arm of claim 1;

a chassis, wherein the wheel arm is pivotably coupled to the chassis via the chassis coupling feature; and a lever provided with (a) a coupling feature at a coupling end configured to engage with the lever engagement feature, and (b) a handle region at a free end opposite to the coupling end.

6. The towed howitzer system of claim 5, wherein the coupling feature of the lever and the lever engagement feature are configured so that the coupling feature of the lever is a passage defined by a wall of the lever, the passage configured to receive the lever engagement feature of the wheel arm.

7. The towed howitzer system of claim 5, wherein:

the lever engagement feature is the cavity, and the coupling feature of the lever is configured to extend into the cavity.

8. The towed howitzer system of claim 5, wherein:

the lever engagement feature is provided as a cavity which extends into the wheel arm;

the cavity extends along an engagement feature axis; and the lever engagement feature is the cavity, and the coupling feature of the lever is configured to extend into the cavity.

9. A method of operation of a towed howitzer system, the howitzer system including:

a wheel arm pivotably coupled to a chassis of the howitzer, the wheel arm comprising:

a chassis coupling feature centered on an arm pivoting axis;

a wheel coupling feature centered on a wheel rotation axis, and wherein the chassis coupling feature is spaced apart from the wheel coupling feature; and a lever which extends from the wheel arm to a handle region at a free end, the lever having a lever engagement feature provided as a protrusion which extends away from the wheel arm along an engagement feature axis, the protrusion comprising a wall defining a cavity with an opening centered on the engagement feature axis, and the wall defines a drain aperture extending through the wall;

wherein the lever, the wheel coupling feature, and the chassis coupling feature are provided in series along the length of the wheel arm;

the method comprising:

a user grasping the handle region of the lever and applying a force to the lever so that the wheel arm pivots relative to the chassis about the arm pivoting axis.

10. The method of claim 9, comprising coupling the lever to the wheel arm.

11. The method of claim 9, wherein the howitzer system further includes a suspension system, and the method comprises:

operating the suspension system with the lever when the lever is disconnected from the wheel arm.

12. A method of manufacture of a wheel arm, the wheel arm including:

a chassis coupling feature centred on a wheel arm pivoting axis;

a wheel coupling feature centred on a wheel rotation axis, wherein the chassis coupling feature is spaced apart from the wheel coupling feature; and a lever engagement feature provided as a protrusion which extends away from the wheel arm along an engagement feature axis, the protrusion comprising a wall defining a cavity with an opening centered on the engagement feature axis, and the wall defines a drain aperture extending through the wall;

wherein the lever engagement feature, the wheel coupling feature and the chassis coupling feature are provided in series along the length of the wheel arm;

the method comprising:

providing a wheel arm precursor; and attaching the lever engagement feature to the wheel arm.

13. The method of claim 12, further comprising:

preparing the region of the wheel arm precursor to which the lever engagement feature is to be attached before attaching the lever engagement feature to the wheel arm precursor.

14. A towed howitzer system comprising:

the wheel arm of claim 1;

a chassis, wherein the wheel arm is pivotably coupled to the chassis via the chassis coupling feature; and a lever provided with (a) a coupling feature at a coupling end configured to engage with the lever engagement feature, and (b) a handle region at a free end opposite to the coupling end.

15. A towed howitzer system comprising:

the wheel arm of claim 2;

a chassis, wherein the wheel arm is pivotably coupled to the chassis via the chassis coupling feature; and a lever provided with (a) a coupling feature at a coupling end configured to engage with the lever engagement feature, and (b) a handle region at a free end opposite to the coupling end.

16. A towed howitzer system comprising:

the wheel arm of claim 1;

a chassis, wherein the wheel arm is pivotably coupled to the chassis via the chassis coupling feature; and a lever provided with (a) a coupling feature at a coupling end configured to engage with the lever engagement feature, and (b) a handle region at a free end opposite to the coupling end.

17. A towed howitzer system comprising:

the wheel arm of claim 3;

a chassis, wherein the wheel arm is pivotably coupled to the chassis via the chassis coupling feature; and a lever provided with (a) a coupling feature at a coupling end configured to engage with the lever engagement feature, and (b) a handle region at a free end opposite to the coupling end.

* * * * *